US008132901B2

(12) United States Patent
Bansyo

(10) Patent No.: US 8,132,901 B2
(45) Date of Patent: Mar. 13, 2012

(54) INKJET PRINTER

(75) Inventor: Toshihiro Bansyo, Tokyo (JP)

(73) Assignee: Riso Kagaku Corporation, Tokyo (JP)

( * ) Notice: Subject to any disclaimer, the term of this patent is extended or adjusted under 35 U.S.C. 154(b) by 500 days.

(21) Appl. No.: 12/320,906

(22) Filed: Feb. 9, 2009

(65) Prior Publication Data

US 2009/0213197 A1 Aug. 27, 2009

(30) Foreign Application Priority Data

Feb. 21, 2008 (JP) ..... 2008-040245

(51) Int. Cl.
*B41J 2/18* (2006.01)

(52) U.S. Cl. ..... 347/89

(58) Field of Classification Search ..... 347/89
See application file for complete search history.

(56) References Cited

U.S. PATENT DOCUMENTS 7,845,784 B2 * 12/2010 Nitta et al. ..... 347/89

OTHER PUBLICATIONS

Dr. Richard Podhajny Ph.D., Some Things to Remember About Dynamic Surface Tension, Apr. 1, 2003, p. 6, paragraph 5.*

* cited by examiner

*Primary Examiner* — Matthew Luu
*Assistant Examiner* — Lisa M Solomon
(74) *Attorney, Agent, or Firm* — Manabu Kanesaka

(57) ABSTRACT

An inkjet printer includes: an ink recycling path that recycles ink; an ink head 1 that performs printing by discharging the recycled ink; an ink supplying port that supplies ink from the ink recycling path to the inside of the ink head while controlling the pressure; and an ink discharging port that discharges ink from the inside of the ink head to the ink recycling path while controlling the pressure. When moving from a standby state where the recycling of ink in the ink recycling path remains stopped to a printing preparing state, an amount of ink smaller than an ink recycling amount during the printing is recycled for a predetermined time. Thereby, leakage of the ink and the inhalation of air bubbles from the nozzle are prevented by suppressing the change in pressure of the nozzle, and ink having high viscosity, which is the cause of these defects, is also removed when the recycling of ink starts.

11 Claims, 6 Drawing Sheets

INKJET PRINTER

BACKGROUND OF THE INVENTION

1. Field of the Invention

The present invention relates to an ink recycling type inkjet printer that performs printing by discharging a recycling ink from an ink head, and more particularly, to a technology of suppressing a change in pressure in a nozzle of an ink head within a predetermined range at the time of starting the recycling of ink.

2. Description of the Related Art

It is known from the related art that an inkjet printer performs printing on a recording medium, such as printing paper, by discharging ink from a nozzle of an ink head. Further, as the inkjet printer, there is a an ink recycling type inkjet printer that continuously recycles ink at the time of printing so as to cool the ink or remove wastes in an ink channel.

The ink recycling type inkjet printer includes an ink recycling path for recycling ink. A downstream side and an upstream side of the ink recycling path are installed with ink tanks through the ink head. Further, a pump, which applies pressure so as to recycle ink, is installed between the ink tanks.

Further, a connection position between the ink recycling path and the ink head is installed with an ink supplying port that supplies ink to the inside of the ink head and an ink discharging port that discharges ink from the inside of the ink head.

Further, the ink head used for the ink recycling type inkjet printer uses a structure where ink can be recycled therein. As one example of the ink head in an ink recycling structure, there is a share mode ink head as shown in FIG. 5. The share mode ink head of FIG. 5 is configured wherein an ink supplying hole 2 and an ink discharging hole 3 are installed inside an ink head 1. The ink supplying hole 2 and the ink discharging hole 3 are communicated with an ink supplying port 4 and an ink discharging port 5, which are installed at an outer side of the ink head 1. Moreover, plural ink chambers 7, which are partitioned by plural partition walls 6 configured of a piezoelectric element are installed between the ink supplying hole 2 and the ink discharging hole 3.

In the share mode ink head 1 shown in FIG. 5, as shown by an arrow in FIG. 5, ink is supplied from the ink supplying port 4 to the inside of the ink head 1 and then flows in each of the ink chambers 7 from the ink supplying hole 2 through an ink supplying channel (not shown) in the ink head 1. Although a portion of the ink, which flows in the ink chamber 7, is discharged from a nozzle 8 that is installed at an approximate center within the ink chamber 7, ink, which is not discharged from the nozzle 8, flows in the ink discharging hole 3. Thereafter, the ink, which flows in the ink discharging hole 3, is discharged from the ink discharging port S to the ink recycling path through the ink discharging channel (not shown) and recycles back the ink recycling path.

Further, the ink head of the ink recycling structure as described above is also described, for example, in JP-A-2006-88575 and the like.

When a channel resistance from the ink supplying port 4 to the nozzle 8 is approximately the same as a channel resistance from the nozzle 8 to the ink discharging port 5, if pressure Pi is applied to the ink supplying port 4 and pressure Po is applied to the ink discharging port 5 at the time of recycling the ink (at the time of printing), a pressure Pn of the nozzle 8 becomes Pn=(Pi+Po)/2 in the ink head of the ink recycling structure such as the share mode ink head 1 shown in FIG. 5.

At this time, when the pressure Pn of the nozzle 8 is a positive pressure larger than 4r/d [Pa] (wherein r is surface tension of the ink, and d is the diameter of nozzle 8), a meniscus of the nozzle 8 breaks, such that ink is leaked from the nozzle 8. To the contrary, when the pressure Pn of the nozzle 8 is a negative pressure larger than −4γ/d [Pa] (wherein γ is the surface tension of the ink and d is the diameter of the nozzle 8), the meniscus of the nozzle 8 breaks, such that bubbles are inhaled from the nozzle 8.

For this reason, when the ink head in the ink recycling structure is used, the pressure in the ink supplying port 4 and the ink discharging port 5 is controlled at the time of recycling the ink, such that the pressure in the nozzle 8 is controlled to be in the range of the above-mentioned equation.

However, when the inkjet printer is not used over a long period of time, that is, as shown in FIG. 6, when the recycling of ink remains stopped for a long time, the viscosity of the ink in the vicinity of the nozzle 8 of the ink head 1 is increased.

Generally, the inkjet printer is needed to recycle ink for a predetermined time (warm up) so as to be able to move from a standby state where the recycling of ink stops to a state where actual printing starts by recycling ink. However, if the inkjet printer of the related art recycles the ink like the above-mentioned state, as shown in FIG. 6, when the viscosity of the ink 9*a* is increased at the upstream side of the nozzle 8, the channel resistance of the upstream side becomes larger than the nozzle 8, such that a large negative pressure is applied to the nozzle 8. As a result, the meniscus breaks, causing air bubbles to be inhaled from the nozzle 8. Further, when the viscosity of ink 9b is increased at the downstream side of the nozzle 8, the channel resistance of the downstream side becomes larger than the nozzle 8, such that a large positive pressure is applied to the nozzle 8. As a result, the meniscus breaks, causing the ink to be leaked from the nozzle 8.

SUMMARY OF THE INVENTION

Accordingly, it is an object of the present invention to provide an inkjet printer capable of suppressing the change in pressure in the nozzle within a predetermined range by making an ink recycling amount smaller than an ink recycling amount during printing, such that ink is not leaked from the nozzle and air bubbles are not inhaled from the nozzle while removing ink having high viscosity, which is the cause of these defects, at the time of starting the recycling of ink.

Hereinafter, a configuration according to an exemplary embodiment of the present invention to solve the above-mentioned problems will be described with reference to the accompanying drawings.

An inkjet printer according to claim 1 of the present invention includes:

an ink recycling path that recycles ink;

an ink head 1 that performs printing by discharging the recycled ink;

an ink supplying port 4 that supplies ink from the ink recycling path to the inside of the ink head 1 while controlling pressure; and an ink discharging port 5 that discharges ink from the inside of the ink head 1 to the ink recycling path while controlling the pressure, wherein when moving from a standby state where the recycling of the ink in the ink recycling path remains stopped to a printing preparing state, an amount of ink smaller than an ink recycling amount during the printing is recycled for a predetermined time.

The inkjet printer according to claim 2 controls the ink recycling amount in the ink recycling path so that when moving from the standby state to the printing preparing state, a pressure Pi in the ink supplying port becomes a positive pressure smaller than 4r/d [Pa] (wherein r is the surface tension of the ink and d is the diameter of a nozzle 8).

In the inkjet printer according to claim 3, the ink recycling path includes an upstream tank 12 that is installed at an upstream side higher than the ink head 1 and a downstream tank 13 that is installed at a downstream side lower than the ink head 1, of the upstream tank 12 and the downstream tank 13, at least the upstream tank 12 being opened to the atmosphere, and the pressure in the ink supplying port 4 being controlled by a liquid surface height of an ink within the upstream tank 12.

In the inkjet printer according to claim 4, the ink recycling path includes the upstream tank 12 that is installed at an upstream side higher than the ink head 1 and the downstream tank 13 that is installed at a downstream side lower than the ink head 1, of the upstream tank 12 and the downstream tank 13, at least the upstream tank 12 being sealed, and the pressure in the ink supplying port 4 being controlled by pressure controlled within the upstream tank 12.

The inkjet printer according to claim 5 controls the ink recycling amount in the ink recycling path so that when moving from the standby state to the printing preparing state, a pressure Po in the ink discharging port becomes a negative pressure smaller than −4r/d [Pa] (wherein r is the surface tension of the ink and d is the diameter of the nozzle 8).

In the inkjet printer according to claim 6, the ink recycling path includes the upstream tank 12 that is installed at an upstream side higher than the ink head 1 and the downstream tank 13 that is installed lower than the ink head 1, of the upstream tank 12 and the downstream tank 13, at least the downstream tank 13 being opened to the atmosphere, and the pressure in the ink discharging port 5 being controlled by a liquid surface height of ink within the downstream tank 13.

In the inkjet printer according to claim 7, the ink recycling path includes the upstream tank 12 that is installed at an upstream side higher than the ink head 1 and the downstream tank 13 that is installed at a downstream side lower than the ink head 1, of the upstream tank 12 and the downstream tank 13, at least the downstream tank 13 being sealed, and the pressure in the ink discharging port 5 being controlled by pressure controlled within the downstream tank 13.

In the inkjet printer according to claim 8 or 9, the ink recycling path is installed with a pump P ($P_1$ and $P_2$) and controls the pressure in the ink supplying port 4 and/or the ink discharging port 5 by the pump P ($P_1$ and $P_2$).

With the inkjet printer according to claim 1 according to the present invention, when moving from the standby state where the recycling of the ink stops to the printing preparing state, that is, when the recycling of the ink starts, the ink recycling amount is smaller than the ink recycling amount during the printing, such that the change in pressure in the nozzle can be suppressed within a predetermined range, which is not affected, even when the viscosity of the ink is increased in the vicinity of the nozzle by stopping the ink from being recycled for a long period of time. Therefore, leakage of the ink from the nozzle and the inhalation of air bubbles from the nozzle do not occur. At the'same time, ink having high viscosity in the vicinity of the nozzle, which is the cause of these defects, can be removed, such that the printer in the printing preparing state can be returned to a normal state efficiently.

With the inkjet printer according to claim 2, the positive pressure applied to the nozzle does not exceed 4r/d [Pa], such that leakage of the ink from the nozzle can be prevented.

With the inkjet printer according to claim 3, at least an upstream tank is opened to the atmosphere, such that the positive pressure control in the nozzle can be performed by the liquid surface height of ink within the upstream tank. Therefore, an expensive pressure sensor or pressure controlling apparatus and the like, which can perform the positive pressure control on the nozzle, is not required, making it possible to save costs.

With the inkjet printer according to claim 4, at least an upstream tank is sealed, such that the positive pressure control in the nozzle can be performed by pressure controlled within the upstream tank.

With the inkjet printer according to claim 5, the negative pressure applied to the nozzle does not fall below −4r/d [Pa], such that the inhalation of air bubbles from the nozzle can be prevented.

With the inkjet printer according to claim 6, at least a downstream tank is opened to the atmosphere, such that the negative pressure control in the nozzle can be performed by the liquid surface height of ink within the downstream tank. Thereby, an expensive pressure sensor or pressure controlling apparatus and the like, which can perform the negative pressure control on the nozzle, is not required, making it possible to reduce costs.

With the inkjet printer according to claim 7, at least a downstream tank is sealed, such that the negative pressure control in the nozzle can be performed by pressure controlled within the downstream tank.

With the inkjet printer according to claim 8 or 9, the positive pressure control and the negative pressure control in the nozzle can be performed by controlling the ink recycling amount using a pump for recycling ink as described in claims 3 or 6, such that the expensive pressure sensor or pressure controlling apparatus and the like, which can control the pressure in the nozzle, is not required, making it possible to save costs.

DETAILED DESCRIPTION OF THE PREFERRED EMBODIMENTS

Hereinafter, an exemplary embodiment of the present invention will be described in more detail with reference to the accompanying drawings.

Figure 1:
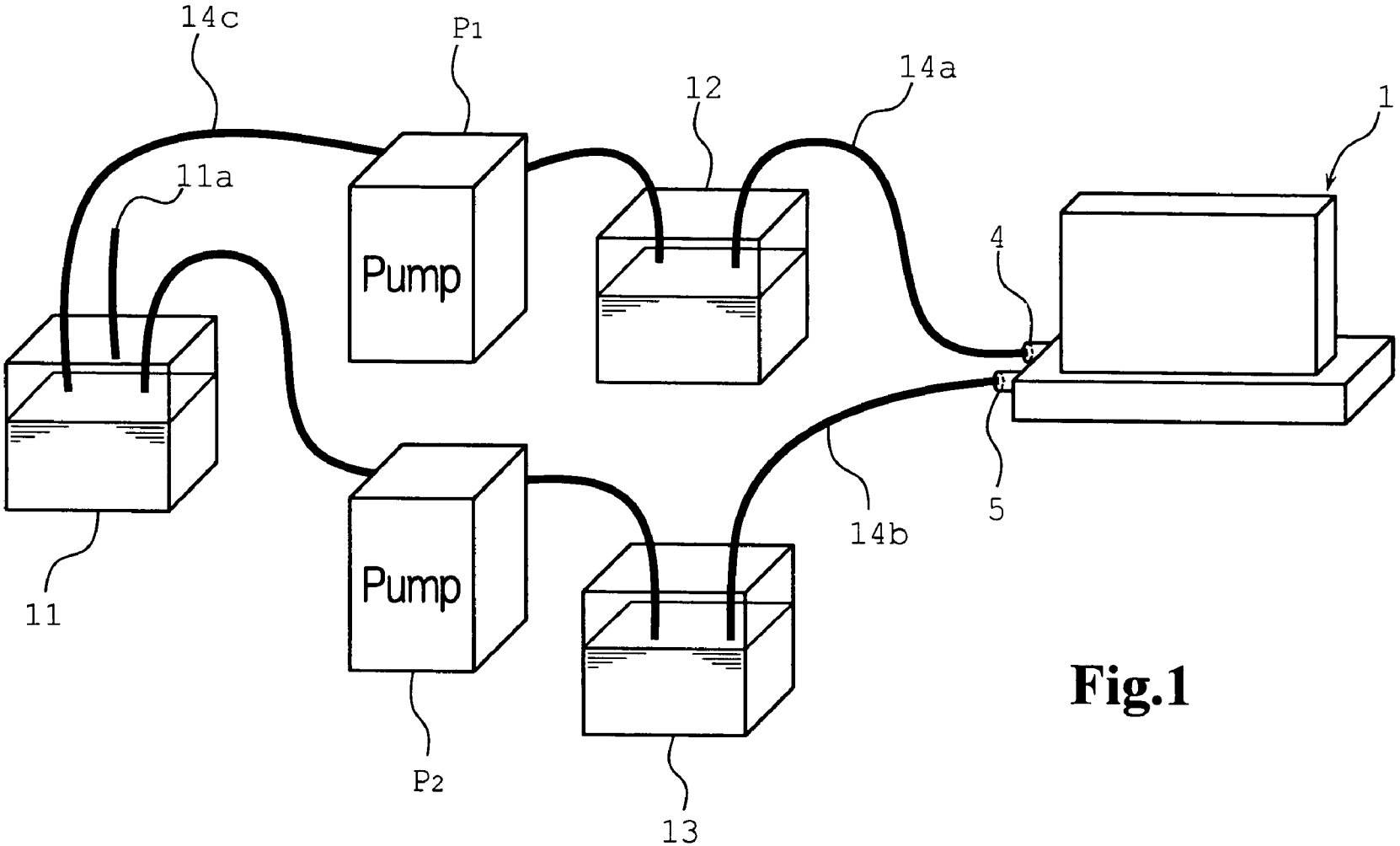
FIG. 1 is a view for explaining a channel configuration of a first exemplary embodiment of an inkjet printer according to the present invention.

FIG. 1 is a view for explaining a channel configuration of a first exemplary embodiment of an inkjet printer according to the present invention.

First Embodiment

Figure 5:
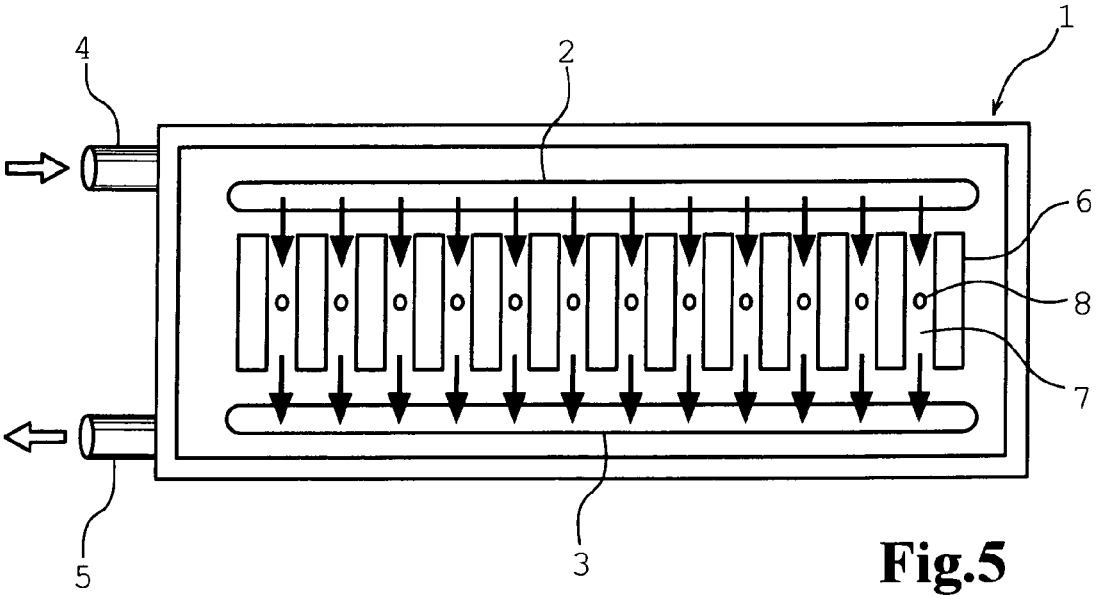
FIG. 5 is a bottom view of an ink head (share mode ink head) of an ink recycling structure.
Figure 6:
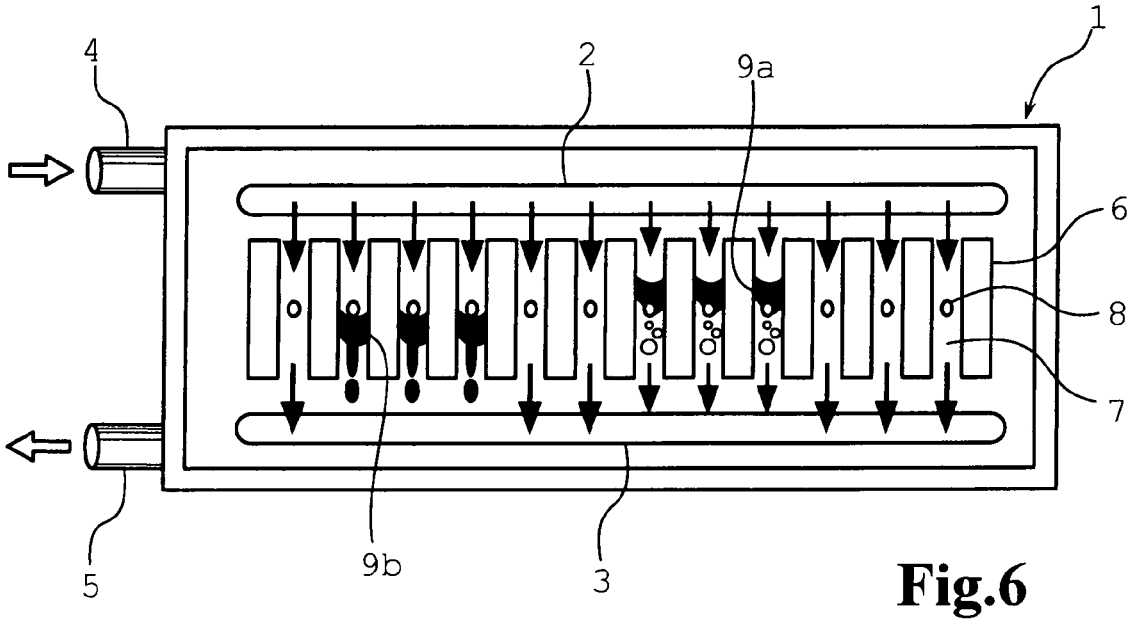
FIG. 6 is a bottom view for explaining defects in the ink head of FIG. 5.

The first exemplary embodiment relates to an ink recycling type inkjet printer continuously recycling ink during printing so as to decrease viscosity of the ink, in particular, in the vicinity of a nozzle 8 (see FIG. 5) of an ink head 1. In FIG. 1, reference numeral 11 denotes an ink bottle that supplies ink, reference numeral 12 denotes an upstream tank that temporarily stores ink supplied from the ink bottle, and reference numeral 13 denotes a downstream tank that temporarily stores ink discharged from the ink head 1.

Also, since the exemplary embodiment uses the share mode ink head 1 (see FIG. 5) as described above, a description of the configuration will be omitted.

As shown in FIG. 1, the share mode ink head 1 (hereinafter, referred to as an ink head), the upstream tank 12, and the downstream tank 13 are channel connected by ink channels 14*a* to 14*c*. Among the ink channels 14*a* to 14*c*, one end of the ink channel 14*a* is connected to an ink supplying port 4 of the ink head 1. Further, one end of the ink channel 14*b* is connected to an ink discharging, port 5 of the ink head 1. Therefore, ink from the upstream tank 12 is supplied to the inside of the ink head 1 through the ink supplying port 4 and is discharged to an downstream tank 13 through the ink discharging port 5.

Further, as shown in FIG. 1, an ink bottle 11 and two pumps ($P_1$ and $P_2$) are installed in the middle of an ink channel 14*c*. One of two pumps ($P_1$ and $P_2$) is installed as the upstream pump $P_1$ between the ink bottle 11 and the upstream tank 12 and the other is installed as the downstream pump $P_2$ between the ink bottle 11 and the downstream tank 13.

In the channel configuration, the upstream tank 12 supplies ink from the ink bottle 11 to the inside of the ink head 1 while controlling the ink recycling amount by the upstream pump $P_1$ and the downstream tank 13 temporarily stores ink, which is not discharged from the ink head 1, and then supplies ink to the ink bottle 11 while controlling the ink recycling amount by the downstream pump $P_2$, thereby forming the ink recycling path. Further, the ink bottle 11 includes an atmospheric opening hole 11*a* that opens the inside of the ink bottle to the atmosphere.

The ink recycling amount in the ink recycling path is controlled by controlling the recycling amount by two pumps ($P_1$ and $P_2$), but the pressure in each of the ports 4 and 5 of the ink head 1 is also controlled by controlling the ink recycling amount. In other words, the ink recycling amount is controlled by the upstream pump $P_1$ to control pressure in the ink supplying port 4, such that a positive pressure applied to the nozzle 8 does not exceed $4\gamma/d$ [Pa] (wherein $\gamma$ is the surface tension of the ink and d is the diameter of nozzle 8). Thereby, leakage of the ink from the nozzle 8 can be prevented during printing. Further, the ink recycling amount is controlled by the downstream pump $P_2$ to control pressure in the ink discharging port 5, such that a negative pressure applied to the nozzle 8 does not fall below $-4\gamma/d$ [Pa] (wherein $\gamma$ is the surface tension of the ink and d is the diameter of nozzle 8). Thereby, the inhalation of air bubbles from the nozzle 8 can be prevented during the printing.

Moreover, when moving from a standby state where the recycling of the ink stops to a printing preparing state for warm up, that is, when the recycling of the ink starts, the ink recycling amount in the ink recycling path is controlled to be the amount of ink that is smaller than the ink recycling amount during printing by two pumps $P_1$ and $P_2$.

With the first exemplary embodiment as described above, when the recycling of ink for warm up starts, the ink recycling amount becomes smaller than the ink recycling amount during printing, so that ink can be smoothly supplied from the ink supplying port 4 to the inside of the ink head 1 and smoothly discharged from the ink discharging port 5. As a result, even when the viscosity of ink is increased in the vicinity of the nozzle 8 by stopping the recycling of the ink for a long period of time, the change in pressure in the nozzle 8 can be suppressed within a predetermined range. Thereby, when the recycling of the ink starts, leakage of the ink from the nozzle 8 and the inhalation of air bubbles from the nozzle 8 do not occur. At the same time, ink with increased viscosity in the vicinity of the nozzle 8 can be removed when the recycling of the ink starts.

Further, when the recycling of the ink starts, the positive pressure applied to the nozzle 8 does not exceed $4\gamma/d$ [Pa], so that leakage of the ink from the nozzle 8 can be prevented.

Moreover, when the recycling of ink starts, the negative pressure applied to the nozzle 8 does not fall below $-4\gamma/d$ [Pa], so that the inhalation of air bubbles from the nozzle 8 can be prevented.

In addition, since the pressure in the nozzle 8 can be controlled by the upstream pump $P_1$ and the downstream pump $P_2$, an expensive pressure sensor or pressure controlling apparatus and the like for controlling the pressure in the nozzle 8 is not required.

Figure 2:
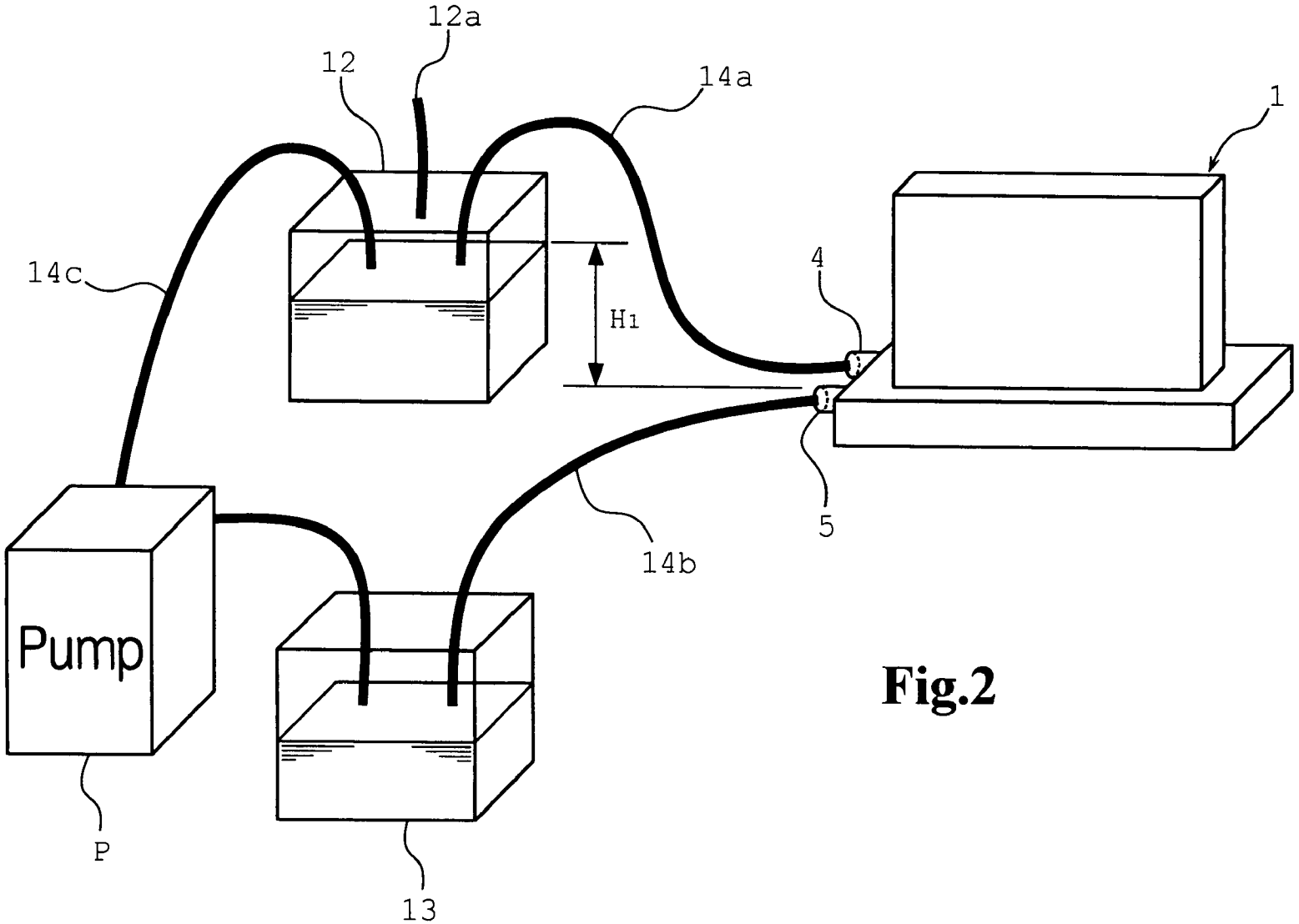
FIG. 2 is a view for explaining a channel configuration of a second exemplary embodiment of an inkjet printer according to the present invention.

FIG. 2 is a view for explaining a channel configuration of a second exemplary embodiment of an inkjet printer according to the present invention. Further, in the exemplary embodiment to be described below, components having the same functions as the components of FIG. 1 are denoted by the same reference numerals and the description thereof will be omitted.

Second Embodiment

The second exemplary embodiment relates to an ink recycling type inkjet printer that continuously recycles ink during printing, similar to the above-mentioned first exemplary embodiment.

As shown in FIG. 2, the pump P is installed in the middle of the ink channel 14*c* so as to supply the ink while controlling the ink recycling amount to the upstream tank 12. Further, the upstream tank 12 includes an atmospheric opening hole 12*a* for opening the inside of the upstream tank 12 to the atmosphere. Further, the downstream tank 13 takes a sealing structure. Also, since the second exemplary embodiment uses the above-mentioned share mode ink head 1 (see FIG. 5), the description of the configuration will be omitted.

In FIG. 2, the pressure in the ink supplying port 4 is controlled by the height difference (water head difference $H_1$) between the ink liquid surface within the upstream tank 12 and the ink discharging surface of the nozzle 8 of the ink head 1. In other words, the positive pressure applied to the nozzle by the water head difference H, does not exceed $4\gamma/d$ [Pa] (wherein $\gamma$ is the surface tension of the ink and d is the diameter of nozzle 8).

Further, the ink recycling amount in the ink recycling path is controlled by controlling the recycling amount using the pump P, but the pressure in the ink discharging port 5 is controlled through the downstream tank 13 in the sealed structure by controlling the ink recycling amount. In other words, the negative pressure applied to the nozzle 8 by the pump P does not fall below $-4\gamma/d$ [Pa] (wherein $\gamma$ is the surface tension of the ink and d is the diameter of the nozzle 8).

Moreover, when moving from a standby state where the recycling of the ink stops to the printing preparing state for warm up, that is, when the recycling of the ink starts, the ink recycling amount in the ink recycling path is controlled to be the amount of ink that is smaller than the ink recycling amount during printing by the pump P.

With the second exemplary embodiment as described above, similar to the first exemplary embodiment, when the recycling of ink for warm up starts, even when the viscosity of ink is increased in the vicinity of the nozzle 8 by stopping the recycling of the ink over a long period of time by making the ink recycling amount smaller than the ink recycling amount during printing, the change in pressure in the nozzle 8 can be suppressed within a predetermined range. Thereby, when the recycling of ink starts, leakage of the ink from the nozzle 8 and the inhalation of air bubbles from the nozzle 8 do not occur. At the same time, ink having high viscosity in the vicinity of the nozzle 8 can be removed when the recycling ink starts.

Further, when the recycling of the ink starts, the positive pressure applied to the nozzle 8 does not exceed $4\gamma/d$ [Pa], so that leakage of the ink from the nozzle 8 can be prevented.

Moreover, when the recycling of the ink starts, the negative pressure applied to the nozzle 8 does not fall below $-4\gamma/d$ [Pa], so that the inhalation of air bubbles from the nozzle 8 can be prevented.

Also, the upstream tank 12 includes the atmospheric opening hole 12*a*, such that the positive pressure in the nozzle 8 can be controlled due to the difference $H_1$ between the height of the ink liquid surface within the upstream tank 12 and the height of the ink discharging surface of the nozzle 8.

In addition, the downstream tank 13 is sealed, such that if the pressure within the downstream tank 13 is controlled, the negative pressure in the nozzle 8 can be controlled.

Figure 3:
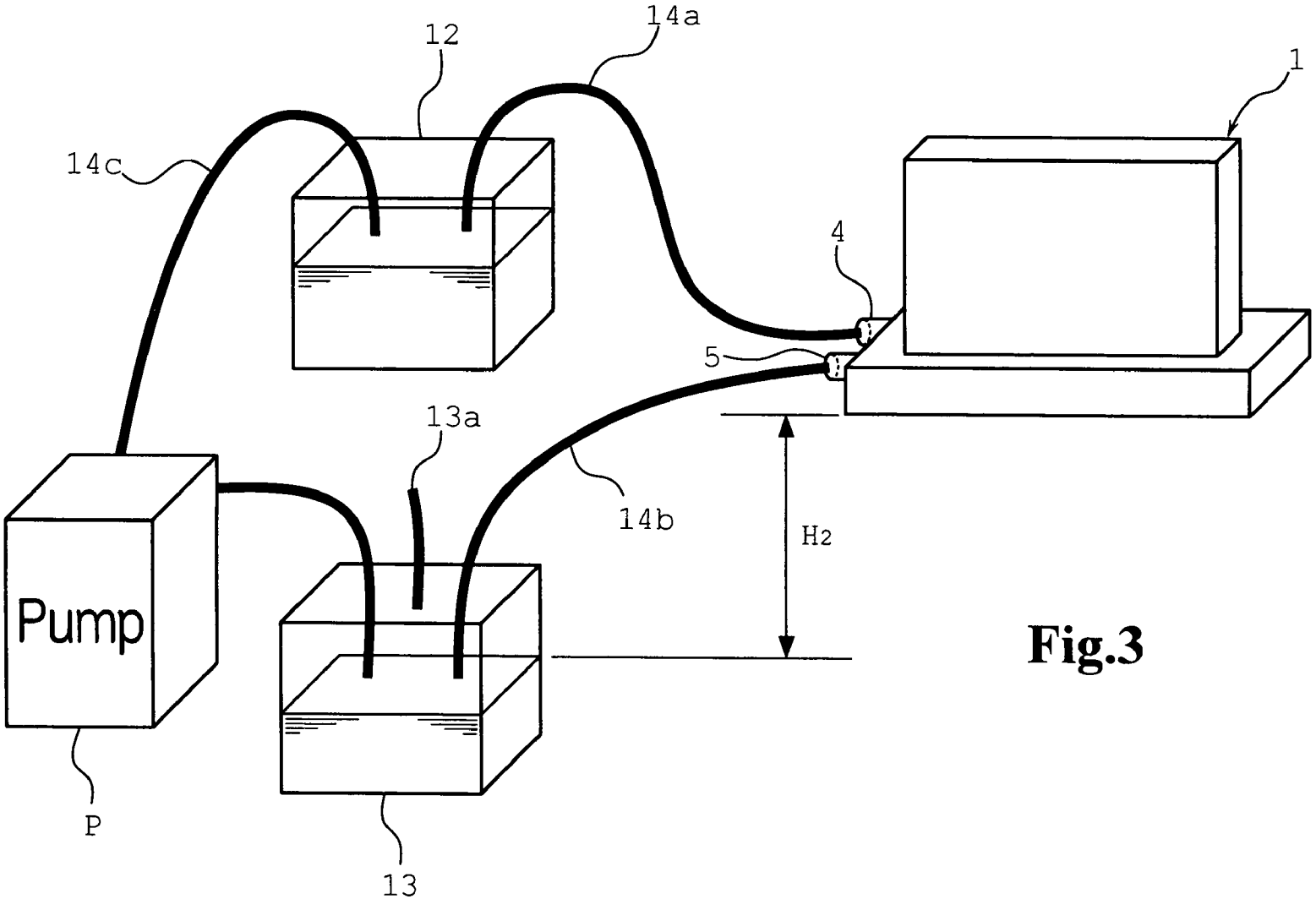
FIG. 3 is a view for explaining a channel configuration of a third exemplary embodiment of an inkjet printer according to the present invention.

FIG. 3 is a view for explaining a channel configuration of a third exemplary embodiment of the inkjet printer according to the present invention. Further, in the exemplary embodiment to be described below, components having the same functions as the components of FIGS. 1 and 2 are denoted by the same reference numerals and the description thereof will be omitted.

Third Embodiment

Similar to the above-mentioned first and second exemplary embodiments, the exemplary embodiment relates to an ink recycling type inkjet printer that continuously recycles ink during the printing.

As shown in FIG. 3, the upstream tank 12 uses a sealed structure and the downstream tank 13 includes an atmospheric opening hole 13*a* for opening the inside of the downstream tank to the atmosphere. Further, since the third exemplary embodiment uses the above-mentioned share mode ink head 1 (see FIG. 5), the description of the configuration will be omitted.

In FIG. 3, the pressure in the ink discharging port 5 is controlled by the height difference (water head difference $H_2$) between the ink liquid surface within the downstream tank 13 and the ink discharging surface of the nozzle 8 of the ink head 1. In other words, the negative pressure applied to the nozzle by the water head difference $H_1$ does not fall below $-4\gamma/d$ [Pa] (wherein $\gamma$ is the surface tension of the ink and d is the diameter of the nozzle 8).

Further, the ink recycling amount in-the ink recycling path is controlled by controlling the recycling amount by the pump P, but the pressure in the ink supplying port 4 is also controlled through the upstream tank 12 in the sealed structure by controlling the ink recycling amount. In other words, the positive pressure applied to the nozzle 8 by the pump P does not exceed $4\gamma/d$ [Pa] (wherein $\gamma$ is the surface tension of the ink and d is the diameter of the nozzle 8).

Moreover, when moving from a standby state where the recycling of ink stops to the printing preparing state for warm up, that is, when the recycling of ink starts, the ink recycling amount in the ink recycling path is controlled to be the amount of ink that is smaller than the ink recycling amount during the printing by the pump P.

With the third exemplary embodiment as described above, similar to the first and second exemplary embodiments, when the recycling of ink for warm up starts, even when the viscosity of ink is increased in the vicinity of the nozzle 8 by stopping the recycling of ink for a long period of time by making the ink recycling amount smaller than the ink recycling amount during printing, the change in pressure in the nozzle 8 can be suppressed within a predetermined range. Thereby, when the recycling of ink starts, the leakage of ink from nozzle 8 and the inhalation of air bubbles from nozzle 8 do not occur. At the same time, ink having high viscosity in the vicinity of the nozzle 8 can be removed when the recycling ink starts.

Further, when the recycling of ink starts, the positive pressure applied to the nozzle 8 does not exceed $4\gamma/d$ [Pa], such that the leakage of ink from the nozzle 8 can be prevented.

Moreover, when the recycling of ink starts, the negative pressure applied to the nozzle 8 does not fall below $-4\gamma/d$ [Pa], such that the inhalation of air bubbles from the nozzle 8 can be prevented.

Also, the upstream tank 12 is sealed, such that if the pressure in the upstream tank 12 is controlled, the positive pressure in the nozzle 8 can be controlled.

In addition, the downstream tank 13 includes the atmospheric opening hole 13*a*, such that the negative pressure in the nozzle 8 can be controlled due to the difference $H_2$ between the height of the ink liquid surface within the downstream tank 13 and the height of the ink discharging surface of the nozzle 8.

Figure 4:
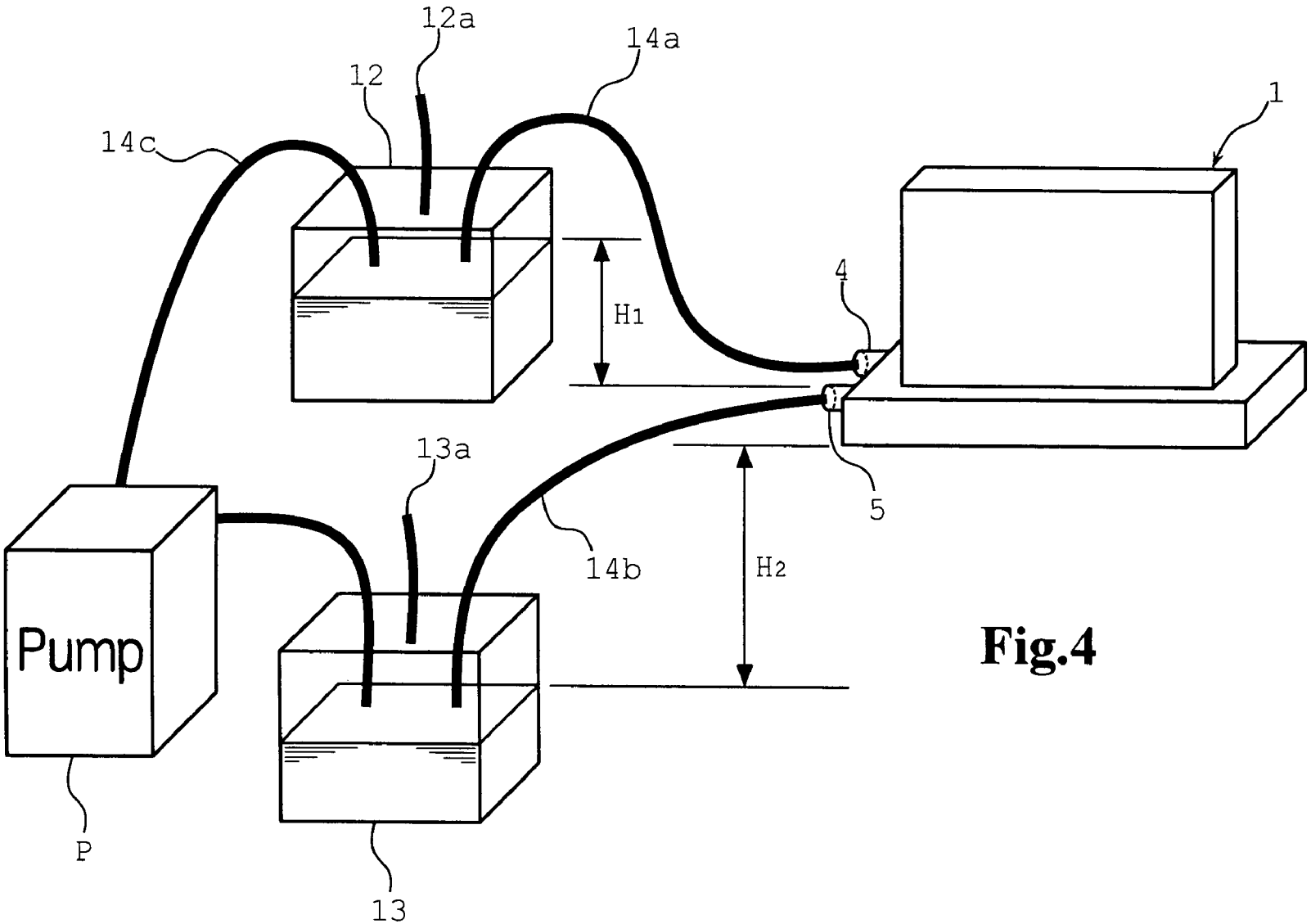
FIG. 4 is a view for explaining a channel configuration of a fourth exemplary embodiment of an inkjet printer according to the present invention.

FIG. 4 is a view for explaining a channel configuration of a fourth exemplary embodiment of the inkjet printer according to the present invention. Further, in the exemplary embodiment to be described below, components having the same functions as the components of FIGS. 1 to 3 are denoted by the same reference numerals and the description thereof will be omitted.

Fourth Embodiment

Similar to the above-mentioned first to third exemplary embodiments, the exemplary embodiment relates to an ink recycling type inkjet printer that continuously recycles ink during the printing.

As shown in FIG. 4, the upstream tank 12 includes an atmospheric opening hole 12*a* for opening the inside of the upstream tank to the atmosphere. Further, the downstream tank 13 includes an atmospheric opening hole 13*a* for opening the inside of the downstream tank to the atmosphere. Moreover, since the fourth exemplary embodiment also uses the above-mentioned share mode ink head 1 (see FIG. 5), the description of the configuration will be omitted.

In FIG. 4, the pressure in the ink supplying port 4 is controlled by the height difference (water head difference $H_1$) between the ink liquid surface within the upstream tank 12 and the ink discharging surface of the nozzle 8 of the ink head 1. In other words, according to the foregoing description, the positive pressure applied to the nozzle by the water head difference $H_1$ does not exceed $4\gamma/d$ [Pa] (wherein $\gamma$ is the surface tension of the ink and d is the diameter of the nozzle 8).

The pressure in the ink discharging port 5 is controlled by the height difference (water head difference $H_2$) between the ink liquid surface within the downstream tank 13 and the ink discharging surface of the nozzle 8 of the ink head 1. In other words, according to the foregoing description, the negative pressure applied to the nozzle by the water head difference $H_2$ does not fall below $-4\gamma/d$ [Pa] (wherein $\gamma$ is the surface tension of the ink and d is the diameter of the nozzle 8).

Further, the ink recycling amount in the ink recycling path is controlled by controlling the recycling amount by the pump P.

Moreover, when moving from a standby state where the recycling of ink stops to the printing preparing state for warm up, that is, when the recycling of ink starts, the ink recycling amount in the ink recycling path is controlled to be the amount of ink that is smaller than the ink recycling amount during printing by the pump P.

With the fourth exemplary embodiment as described above, similar to the first to third exemplary embodiments, when the recycling of the ink for warm up starts, even when the viscosity of ink is increased in the vicinity of the nozzle 8 by stopping the recycling of the ink for a long period of time by making the ink recycling amount smaller than the ink recycling amount during printing, the change in pressure in the nozzle 8 can be suppressed within a predetermined range. Thereby, when the recycling of the ink starts, leakage of the ink from the nozzle 8 and the inhalation of air bubbles from the nozzle 8 do not occur. At the same time, ink having high viscosity in the vicinity of the nozzle 8 can be removed when the recycling ink starts.

Further, when the recycling of ink starts, the positive pressure applied to the nozzle 8 does not exceed $4\gamma/d$ [Pa], such that leakage of the ink from the nozzle 8 can be prevented.

Moreover, when the recycling of ink starts, the negative pressure applied to the nozzle 8 does not fall below $-4r/d$ [Pa], such that the inhalation of air bubbles from the nozzle 8 can be prevented.

Also, the upstream tank 12 includes the atmospheric opening hole 12*a*, such that the positive pressure in the nozzle 8 can be controlled due to the difference H, between the height of the ink liquid surface within the upstream tank 12 and the height of the ink discharging surface of the nozzle 8.

Also, the downstream tank 13 includes the atmospheric opening hole 13*a*, such that the negative pressure in the nozzle 8 can be controlled due to the difference $H_2$ between the height of the ink liquid surface within the downstream tank 13 and the height of the ink discharging surface of the nozzle 8.

What is claimed is:

1. An inkjet printer comprising:

an ink recycling path that recycles ink;

an ink head that performs printing by discharging the recycled ink;

an ink supplying port that supplies ink from the ink recycling path to an inside of the ink head while controlling pressure;

an ink discharging port that discharges ink from the inside of the ink head to the ink recycling path while controlling the pressure; and a pump installed in the ink recycling path, the pump controlling an amount of ink, for a predetermined time, to be smaller than an ink recycling amount during the printing when moving from a standby state where the recycling of the ink in the ink recycling path remains stopped to a printing preparing state.

2. The inkjet printer according to claim 1, wherein the ink recycling amount in the ink recycling path is controlled by the pump so that when moving from the standby state to the printing preparing state, a pressure in the ink supplying port becomes a positive pressure smaller than $4\gamma/d$ Pa, wherein r is a surface tension of the ink and d is a diameter of a nozzle.

3. The inkjet printer according to claim 2, wherein the ink recycling path includes an upstream tank that is installed at an upstream side higher than the ink head and a downstream tank that is installed at a downstream side lower than the ink head; in the upstream tank and the downstream tank, at least the upstream tank being opened to the atmosphere; and the pressure in the ink supplying port being controlled by a liquid surface height of ink within the upstream tank.

4. The inkjet printer according to claim 2, wherein the ink recycling path includes an upstream tank that is installed at an upstream side higher than the ink head and a downstream tank that is installed at a downstream side lower than the ink head; in the upstream tank and the downstream tank, at least the upstream tank being sealed; and the pressure in the ink supplying port being controlled by pressure controlled within the upstream tank.

5. The inkjet printer according to claim 1, wherein the ink recycling amount in the ink recycling path is controlled by the pump so that when moving from the standby state to the printing preparing state, a pressure in the ink discharging port becomes a negative pressure smaller than -4r/d PA wherein r is a surface tension of the ink and d is a diameter of the nozzle.

6. The inkjet printer according to claim 5, wherein the ink recycling path includes the upstream tank that is installed at an upstream side higher than the ink head and the downstream tank that is installed at a downstream side lower than the ink head; in the upstream tank and the downstream tank, at least the downstream tank being opened to the atmosphere; and the pressure in the ink discharging port being controlled by a liquid surface height of ink within the downstream tank.

7. The inkjet printer according to claim 5, wherein the ink recycling path includes the upstream tank that is installed at an upstream side higher than the ink head and the downstream tank that is installed at a downstream side lower than the ink head; in the upstream tank and the downstream tank, at least the downstream tank being sealed; and the pressure in the ink discharging port being controlled by pressure controlled within the downstream tank.

8. The inkjet printer according to claim 3, wherein the pump controls the pressure in the ink supplying port and/or the ink discharging port.

9. The inkjet printer according to claim 6, wherein the pump controls the pressure in the ink supplying port and/or the ink discharging port.

10. The inkjet printer according to claim 2, wherein the pump includes an upstream pump that is installed at an upstream side of the ink supplying port and a downstream pump that is installed at a downstream side of the ink discharging port.

11. The inkjet printer according to claim 5, wherein the pump includes an upstream pump that is installed at an upstream side of the ink supplying port and a downstream pump that is installed at a downstream side of the ink discharging port.

* * * * *